US007378976B1

(12) United States Patent
Paterno

(10) Patent No.: US 7,378,976 B1
(45) Date of Patent: May 27, 2008

(54) NIGHT LIGHT AND ALARM DETECTOR

(76) Inventor: David Joseph August Paterno, 923 S. Sparks St., State College, PA (US) 16801

( * ) Notice: Subject to any disclaimer, the term of this patent is extended or adjusted under 35 U.S.C. 154(b) by 183 days.

(21) Appl. No.: 11/318,099

(22) Filed: Dec. 23, 2005

Related U.S. Application Data

(60) Provisional application No. 60/641,746, filed on Jan. 7, 2005.

(51) Int. Cl.
*G08B 17/10* (2006.01)

(52) U.S. Cl. ..... 340/628; 340/384.1; 340/629; 340/632; 340/815.4

(58) Field of Classification Search ..... 340/628
See application file for complete search history.

(56) References Cited

U.S. PATENT DOCUMENTS

| | | | | |
|---|---|---|---|---|
| 3,739,226 | A | 6/1973 | Seiter et al. | |
| 4,305,069 | A | 12/1981 | Machen et al. | |
| 4,419,658 | A | 12/1983 | Jarosz et al. | |
| 4,570,155 | A | 2/1986 | Skarman et al. | |
| 4,812,827 | A * | 3/1989 | Scripps | 340/693.1 |
| 5,786,767 | A * | 7/1998 | Severino | 340/628 |
| 6,181,251 | B1 * | 1/2001 | Kelly | 340/628 |
| 6,249,221 | B1 | 6/2001 | Reed | |
| 6,420,973 | B2 * | 7/2002 | Acevedo | 340/628 |
| 6,492,907 | B1 | 12/2002 | McCracken | |
| 6,518,878 | B1 | 2/2003 | Skoff | |
| 6,819,257 | B2 | 11/2004 | Swieboda et al. | |
| 6,864,799 | B2 | 3/2005 | Popps et al. | |
| 7,068,177 | B2 * | 6/2006 | Tice | 340/630 |
| 2001/0038336 | A1 * | 11/2001 | Acevedo | 340/628 |
| 2003/0092297 | A1 | 5/2003 | Reindle et al. | |
| 2003/0193799 | A1 | 10/2003 | Bohler | |
| 2005/0152128 | A1 | 7/2005 | Campman | |
| 2005/0195089 | A1 * | 9/2005 | Shomali | 340/652 |
| 2007/0001866 | A1 * | 1/2007 | Sebescak | 340/628 |

* cited by examiner

*Primary Examiner*—George Bugg

(57) ABSTRACT

This invention relates to providing convenient night and pathway lighting this is integrated into a detector unit. Incorporating the illumination features into the detector unit provides the possibility to simplify the installation, utilize the backup battery power of the detector such that the illumination is provided even in a power outage, and further to allow illumination options that are directly linked to alarm events determined by the detector.

8 Claims, 2 Drawing Sheets

Illumination and Alarm detector Block Diagram

Figure 1 Presently available Alarm detector Block Diagram
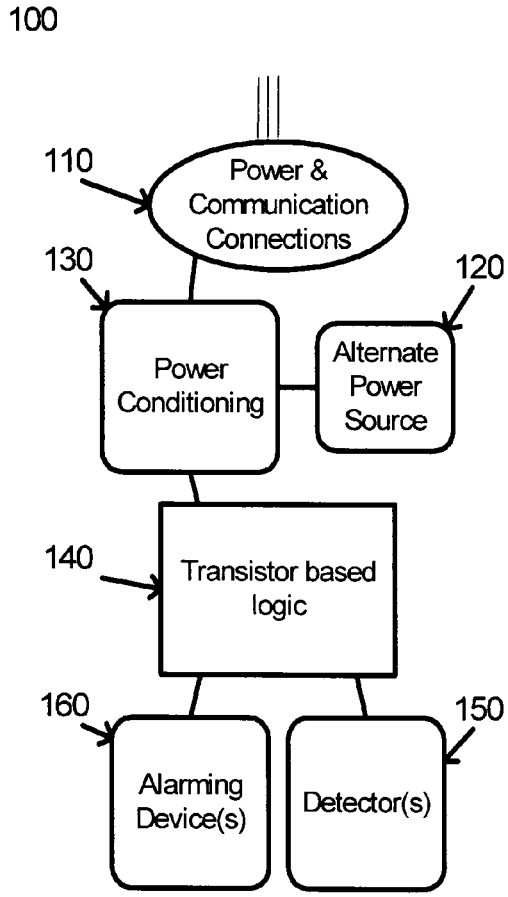

Figure 2 Illumination and Alarm detector Block Diagram
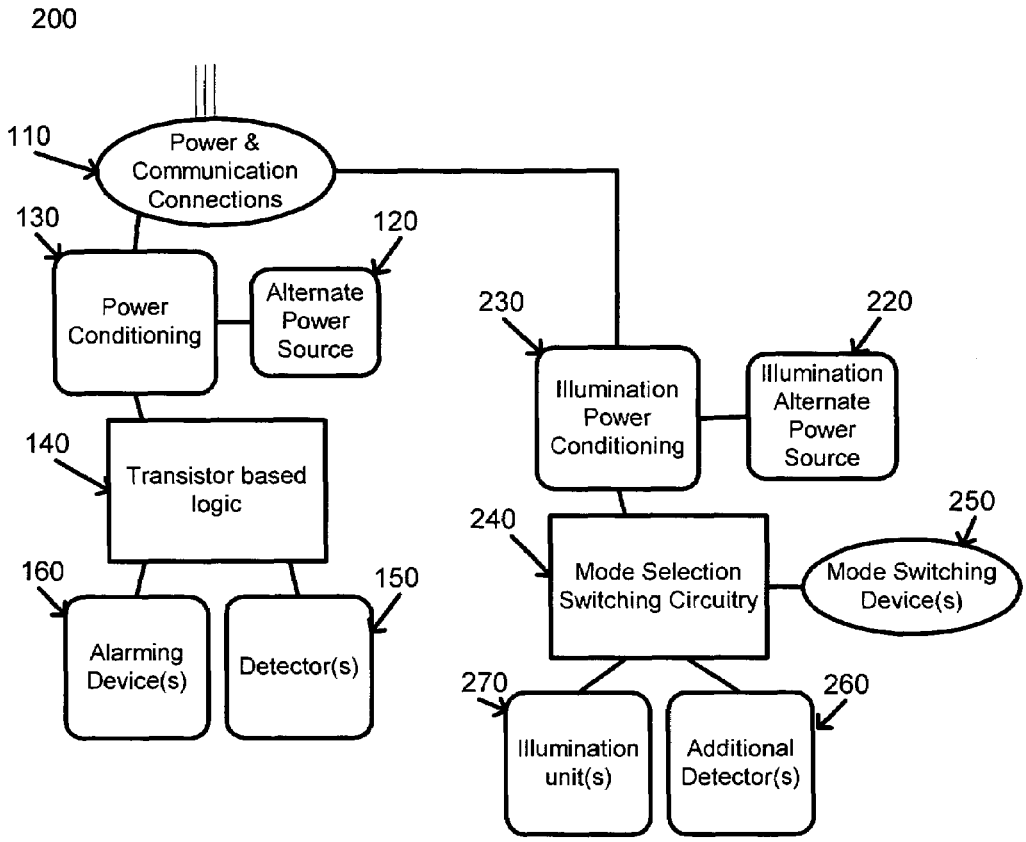

NIGHT LIGHT AND ALARM DETECTOR

CROSS-REFERENCE TO RELATED APPLICATIONS

This application claims the benefit and priority of provisional application, application No. 60/641,746, filed Jan. 7, 2005.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISK APPENDIX

Not Applicable.

BACKGROUND OF INVENTION

This invention relates to providing convenient night and pathway lighting that is integrated into a detector unit. Incorporating the illumination features into the detector unit provides the possibility to simplify the installation, utilize the backup battery power of the detector such that the illumination is provided even in a power outage, and further to allow illumination options that are directly linked to alarm events determined by the detector.

Alarm detector units provide safety. Most common, smoke alarms and carbon monoxide detectors are required in most residential building codes. Many current models work on standard building electrical current, with the option of a battery backup to keep the units functioning during occasional power outages. Some new construction building codes further require that smoke/fire alarm units also interconnect to each other, so that when any one unit detects an alarm condition, all units will sound their internal alarms throughout the building premises. Other devices exist that provide night and pathway lighting. While some are built into the structure of a building, most residential models are temporary and plug into an appliance outlet. Integrating the illumination functions into the alarm detector unit provides convenience and safety features that are not currently available at a low cost.

DETAILED DESCRIPTION

In the description herein, numerous specific details are provided, such as examples of components and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, and/or the like. In other instances, well-known structures, materials, or operations are not shown or described in detail to avoid obscuring aspects of embodiments of the invention.

In the description herein alarm detectors include but are not limited to; smoke, fire, heat, specific gas, motion, sound, light, and vibration detectors. For simplicity and not limitation, the description herein will discuss the present invention as it applies to a few specific types of detectors.

FIG. 1 is a block diagram that illustrates the basic components of presently available alarm detector units.

Present alarm detectors may include; power and communications connections 110, alternate power source 120, power conditioning 130, transistor logic 140, purpose specific detectors 150, and alarming devices 160. As described herein, power conditioning refers to filtering, rectifying, regulating, and/or dividing as appropriate to match the conditions of the power source to the circuit components.

Returning to FIG. 1, a typical home smoke alarm for example connects to the alternating current house wiring for primary power, and may or may not include a backup battery. The unit performs power conditioning to convert the high voltage alternating current to a low voltage direct current, and when a backup battery is present, the transistor logic handles switching over to the battery only when the primary power is not present. The transistor logic continuously monitors signals from the smoke and/or heat detectors, and determines when a change in conditions exist that may indicate a fire, such as a rapid rise in temperature and/or density of air borne particles. When such an alarm event is determined by the transistor logic, it further exercises drive circuits to outputting devices such as audible alarms, and other alarm units through an interconnection line if present. When present, the interconnection communications between alarm detectors provides two way communications between multiple alarm detectors. Thus it allows a unit to receive alarm triggers from other units, and provides it a means to signal other units of alarm conditions it detects.

FIG. 2 is a block diagram that illustrates the present invention. The present invention includes the general components of the alarm detector as described in FIG. 1 as well as the additional modules introduced in FIG. 2; illumination power conditioning 230, illumination alternate power source 220, mode selection switching circuitry 240, mode switching device(s) 250, additional detector(s) 260, and illumination unit(s) 270.

Depending on choice of illumination units 270, installation specifics and regional building code requirements, it may be preferred for the present invention to include additional power conditioning 230 and additional alternate power source 220. For instance, certain illumination units can operate on the same voltage conditions as the alarm detector circuitry, while others can not. In its preferred embodiment the present invention shares components for power conditioning, alternate power source, logic circuitry, and detectors between the two primary functions: alarm detection and illumination. The present invention provides alarm detection and convenience lighting in the proximity of the apparatus. The switching device(s) 250 allows a person to select the mode of lighting they desire. For instance, the apparatus can be set to provide illumination only during an alarm condition, or for both alarm conditions and any time the ambient lighting level is below a certain threshold or for alarm conditions and just low ambient lighting levels during failure of the primary power source.

Based on circuitry defined logic the present invention 200 illuminates illumination devices when the conditions exist that the user selected for illumination. One set of conditions that the user may select by interacting with the mode switching devices 250 is the alarm only illumination mode. In this mode when the present invention 200 detects an alarm, or receives an alarm trigger from another alarm detector, the mode selection switching circuitry activates the illumination units for alarm condition illumination. In one embodiment of the present invention, the present invention includes a unique illumination scheme just for alarm conditions, such as a flashing strobe light.

A second set of conditions that the user may select by interacting with the mode switching devices 250 is the alarm and night light illumination mode. In this mode the present invention will likewise activate illumination units 270 for alarm conditions, and by utilizing a light detector 260 will also illuminate convenient night light illumination when the ambient light level around the present invention is below a set threshold. In one embodiment of the present invention the alarm condition illumination and the night lighting illumination may be the same illumination scheme. A variation of this mode would include a motion or infrared detector 260 in the present invention used to initiate illumination based on a person entering the proximity of the unit 200.

Yet another set of conditions the user may select by interacting with the mode switching devices 250 is the alarm and power outage illumination mode. In this mode the present invention will likewise activate illumination units 270 for alarm conditions, and using appropriate circuitry in the power conditioning module 230 will activate power outage illumination when the power conditioning module 230 is operating on the alternate power source and the detectors 260 indicate night light illumination conditions exist (lack of ambient light, or detection of a person in proximity to the unit 200).

It it's simplest embodiment the present invention 200 uses one illumination unit, uses a 3 position mode switch, passive components with wired logic circuitry for illumination, and shares power conditioning and alternate power source with the alarm detector modules.

The following example illustrates one of many possible uses of the present invention, so the utility of the invention can be understood. A family may decide to install several smoke alarms and carbon monoxide alarms in their home. By choosing to use the present invention for some of these alarms, the family can enjoy convenient assistance on a daily basis, and improved safety during alarm events and power outages. In the bedroom of their new born baby, they set the unit to the alarm and night light illumination mode. They also set the unit in the bedroom hallway this way. For the unit in the parent's bedroom however, they select the alarm only illumination mode. They have two other units in common living areas, and decide to set these in the alarm and power outage modes so they can easily find their way around in a power outage. Because the present invention is compatible with existing alarm detectors, the family can also utilize basic alarm units in locations where no detector provided illumination is desired. They will still benefit from the interconnection with the non-illumination alarm detectors, in that alarm events detected by the basic units will initiate alarming in all units.

In its preferred embodiment the present invention uses low cost low power LED illumination devices. These provide years of operation, adequate pathway lighting, and consume about 100 milliWatts per LED light. Further, they operate on low voltage direct current power that is compatible with standard smoke and carbon monoxide alarms.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. An integrated lighting and detector device comprising:

a) a source of illumination;

b) a sensor for detecting the level of ambient light;

c) at least one other sensor for detecting an alarm event; and d) a mode select switch for providing at least two user selectable illumination options wherein said options comprise:

i) an alarm only illumination mode whereby the illumination source will illuminate only in response to the alarm event sensor; and ii) an alarm and night-light illumination mode whereby the illumination source will illuminate in response to either the ambient light sensor or the alarm event sensor.

2. The device according to claim 1 wherein the alarm event sensor is selected from the group consisting of smoke, carbon monoxide, fire, temperature, motion, vibration, and sound.

3. The device according to claim 1 wherein the light source is an LED light source.

4. The device according to claim 1 containing a battery backup means and an additional sensor that detects the loss of primary power.

5. The device according to claim 4 wherein the mode select switch has a third option whereby the illumination source will illuminate only in response to an alarm event or a power outage.

6. The device according to claim 1 wherein the light source will operate under a different illumination scheme depending on the mode selected.

7. The device according to claim 1 wherein the light source will operate under a different illumination scheme depending on whether an alarm event or low ambient light is detected.

8. The device according to claim 5 wherein the light source will operate under a different illumination scheme depending on whether an alarm event, low ambient light, or power outage is detected.

* * * * *